United States Patent [19]

Ney et al.

[11] Patent Number: 4,695,105

[45] Date of Patent: Sep. 22, 1987

[54] FILTERED ELECTRICAL RECEPTACLE

[75] Inventors: Reuben E. Ney, Mount Joy; Raymond V. Pass, Camp Hill; Patrick F. Yeager, Middletown, all of Pa.

[73] Assignee: AMP Incorporated, Harrisburg, Pa.

[21] Appl. No.: 828,566

[22] Filed: Feb. 10, 1986

Related U.S. Application Data

[63] Continuation of Ser. No. 683,846, Dec. 20, 1984, abandoned.

[51] Int. Cl.[4] ..... H01R 4/66; H01R 13/66

[52] U.S. Cl. ..... 439/95; 333/185; 439/620

[58] Field of Search ..... 333/181–185; 339/14 R, 143 R, 147 R, 147 P

[56] References Cited

U.S. PATENT DOCUMENTS

| | | | |
|---|---|---|---|
| 3,569,915 | 3/1971 | Sorensen et al. | 339/147 |
| 3,696,319 | 10/1972 | Olsson | 339/17 LC |
| 3,825,874 | 7/1974 | Peverill | 339/147 R |
| 3,850,498 | 11/1974 | Schor | 339/147 R |
| 3,854,107 | 12/1974 | Tuchto et al. | 339/147 R |
| 3,901,574 | 8/1975 | Paullus et al. | 339/90 R |
| 3,961,294 | 6/1976 | Hollyday | 339/143 R |
| 4,020,430 | 4/1977 | Vander Heyden | 333/183 |
| 4,029,386 | 6/1977 | Krantz, Jr. et al. | 339/143 R |
| 4,083,022 | 4/1978 | Nijman | 339/147 R |
| 4,212,510 | 7/1980 | Ritchie et al. | 339/147 R |
| 4,215,326 | 7/1980 | Hollyday | 339/147 R |
| 4,275,945 | 6/1981 | Krantz et al. | 333/182 |
| 4,296,390 | 10/1981 | Vanderheyden et al. | 339/147 R |
| 4,457,575 | 7/1984 | Davis et al. | 339/143 R |
| 4,493,525 | 1/1985 | Hall et al. | 339/143 R |
| 4,518,209 | 5/1985 | Negley | 339/17 LC |
| 4,521,062 | 6/1985 | Kurbikoff et al. | 339/17 LC |

FOREIGN PATENT DOCUMENTS

| | | | |
|---|---|---|---|
| 2733634 | 2/1979 | Fed. Rep. of Germany | 339/147 R |

*Primary Examiner*—Gil Weidenfeld
*Assistant Examiner*—Gary F. Paumen
*Attorney, Agent, or Firm*—Katherine A. Nelson

[57] ABSTRACT

A filtered electrical connector comprises three main parts, a header housing in which are located a plurality of socket contacts, an apertured filter ground plate connected to ground and having located therein a number of hollow tubular filter sleeve elements corresponding to the number of socket contacts, the latter elements having stems or legs located in the filter sleeve elements and soldered thereto and a ground plate secured to the front of the housing and providing a connector between ground and the shell of a pin connection adapted to be inserted into the receptacle.

6 Claims, 4 Drawing Figures

FILTERED ELECTRICAL RECEPTACLE

This application is continuation of application Ser. No. 683,846 filed Dec. 20, 1984, now abandoned.

RELATED APPLICATIONS

This application is related to a U.S. application Ser. No. 684,229 filed on concurrent date herewith by, Raymond V. Pass and James L. Schroeder, III Reuben Earl Ney entitled "Filtered Electric Plug" and assigned to the same assignee as the present invention. Application Ser. No. 856,429 was a continuation of serial number 684,229 (abandoned), and is now U.S. Pat. No. 4,684,681.

BACKGROUND OF THE INVENTION

The present invention relates to electrical receptacles and more particularly to a receptacle having interference filter elements; said receptacle intended to be secured to a printed circuit board and receive the contacts of a multiple pin connector.

Multiple contact receptacles are employed extensively to interconnect the circuits on a printed circuit board of a computer, instrument, sophisticated communications equipment or the like to multiple conductor cables via multiple pin connectors. In order to minimize transmission of electrical noise into or out of the equipment via the connectors and cables, low pass filters are provided which in many cases constitute shunt capacitors to ground.

BRIEF DESCRIPTION OF THE PRESENT INVENTION

The present invention contemplates a multiple pin receptacle for connection to a printed circuit board or the like that is composed of a few single, mostly stamped or drawn, elements that in quantity production lend themselves to automated assembly.

The receptacle consists primarily of a nonconductive header housing for receiving a plurality of socket contacts in separate passages in the housing. The socket contacts are basically right angle members with a stem member extending perpendicular to the pin contact receiving contacts located in the housing. A separate tubular insulating member coated with conductive material on its inner and outer surfaces which insulating member constitutes the dielectric of a filter sleeve, is dispersed about each stem and held in place by a filter grounding plate that receives each tubular member in a separate aperture and provides both the outer contact of each tubular filter sleeve and the ground connection. The stems that are seated in the tubular members provide the other contact to the capacitor plates.

Assembly is accomplished by soldering the stem to the conductive material on the inner surface of the insulating member and the filter grounding plate is soldered to the outer conductive surface of the tubular members. The contact parts of the socket contacts are then inserted in the bores in the header housing. The header housing has a recessed region that provides an axially extending skirt from the surface opposite insertion of the socket contacts. A ground plate has a large aperture in the center surrounded by spring fingers that extend into the recess region of the header housing and may be secured to a printed circuit board along with the stems to both electrical shields of the apparatus and help secure it to the printed circuit board. The filter ground also has stems or legs that extend into and are connected to the ground plane of the printed circuit board.

The entire assembly comprises a plurality, three to eight or more socket contacts, a plurality of tubular members in numbers equal to the socket contacts, a header housing and two ground plates; specifically three members in addition to the contacts and tubular filter sleeves.

It is thus a primary object of the present invention to provide a simple, easily assembled and cost effective filtered electrical receptacle and more particularly such an apparatus for use with the filtered electrical plug of said concurrently filed application.

DETAILED DESCRIPTION OF A PREFERRED EMBODIMENT

Figure 1:
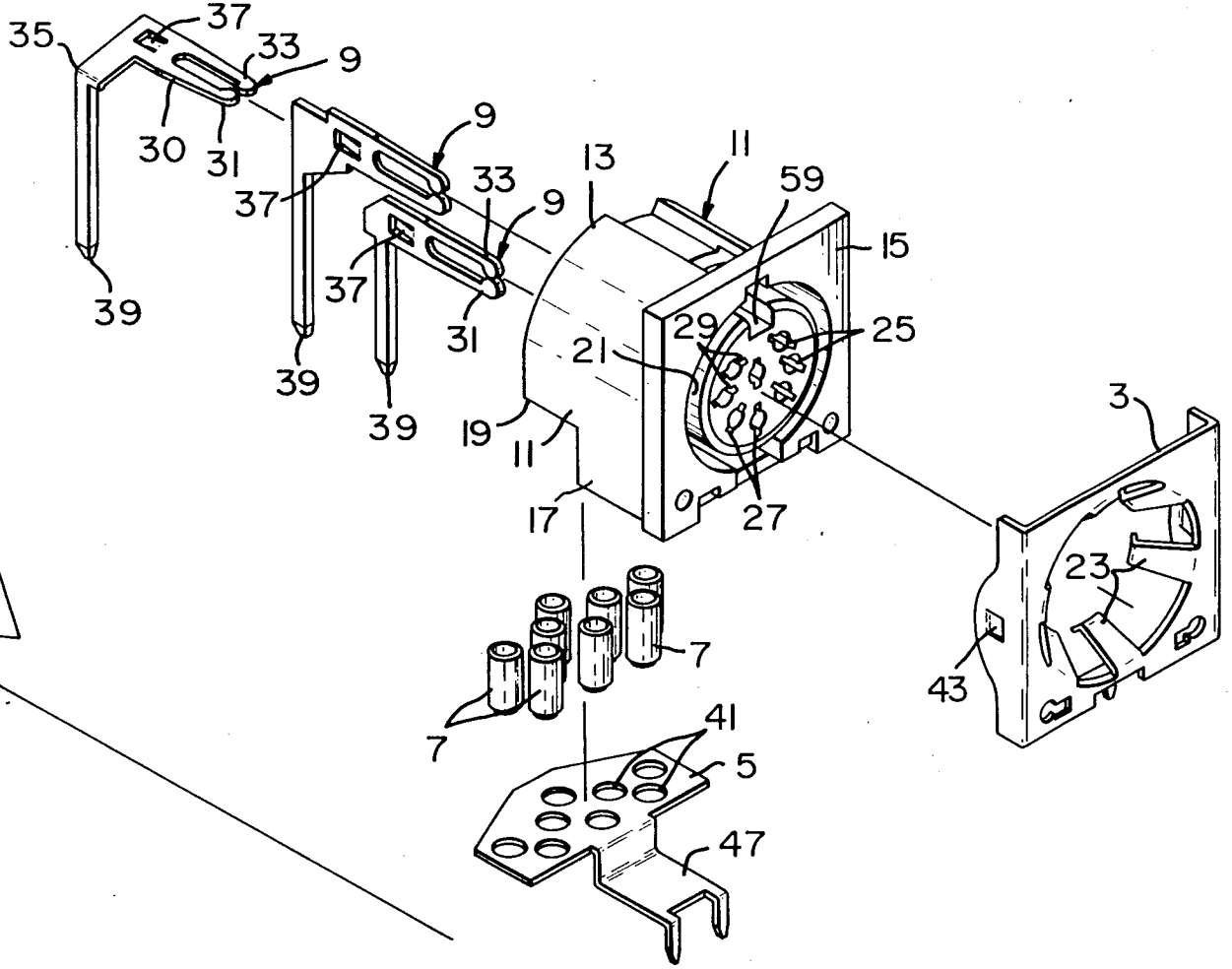
FIG. 1 is an exploded view of all of the elements of the present invention.

Referring specifically to FIG. 1 of the accompanying drawings, the elements of the structure of the present invention are a header housing 1, a ground plate 3, a filter ground plate 5, a plurality of filter sleeve elements 7 and an equal plurality of socket contacts 9.

Figure 3:
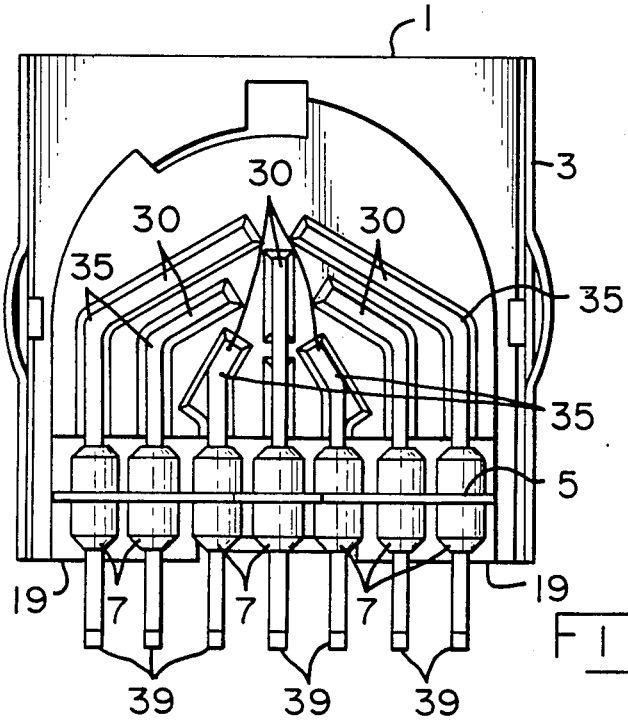
FIG. 3 is a view looking into one end of the receptacle.

The header housing 1, and reference is made to both FIGS. 1 and 3, comprises a body 11 having a semicylindrical upper half 13 as viewed in FIG. 1 and a rectangular front face 15. Adjacent the front face 15, the semicylindrical body has a downwardly extending rectangular body member 17 having a flat bottom surface which together with the bottom surface of the front face is adapted to seat flush against a surface of a printed circuit board to which the receptacle is to be connected.

To the left as viewed in FIG. 1 of the rectangular member 17, the housing 1 terminates in a flat surface 19 for purposes to be explained subsequently. The front surface 15 of the housing 1 is annularly recessed axially to a depth approximately equal to the exposed lengths of the pins of the aforesaid concurrently filed application of Pass et al and is of a diameter to receive the shell of the connector of such application or of other connectors having an appropriate pin and shell arrangement. The annular recess is designated by reference numeral 21 and is also adapted to receive spring fingers 23 of ground plate 3.

The housing 1 has a plurality of axial bores 25 which extend completely through the housing in a geometric pattern corresponding to the pattern of pins to be received by the receptacle. The axial bores are circular in cross section with diametrically opposed slots 27 and 29 extending outward to receive tines of the socket contacts 9 upon insertion of the mating pin contacts as is explained more fully below.

Each socket contact 9 is a right angle member with a contact 30 constituting flat tines 31 and 33 spaced apart to receive a pin contact between the tines. The contacts are each inserted in a different bore 25 and where necessary to accommodate the bore array are bent as at 35 in FIGS. 1 and 4.

Each socket contact has a spring finger 37 which when inserted in a bore 25 engages a shoulder in the bore so that it cannot be retracted from the housing. Each socket contact has a leg 39 extending perpendicular to the contact part 30.

Before insertion in the bores 25, each leg of the contact 9 is inserted into a capacitor 7 and soldered to the interior surface thereof. The tubular filter sleeve members 7 may be tubular capacitor members of the standard type or preferably be of the type such as those disclosed in U.S. Pat. Re 29,258, the disclosure of which is incorporated herein. Before soldering to the legs 39, each filter sleeve 7 is placed in a different hole 41 in filter ground plate 5 and soldered therein. The assembled plate 5, filter sleeves 7 and contact receptacles 9 are now assembled to the housing 1 by insertion of each contact 30 into a different bore 25 in the housing. The filter sleeve 7 underlying the surface are in contact therewith.

Assembly is completed by applying the grounding plate 3 to the front of the connector housing 1, the ground plate having spring fingers 43 which engage the rear of the face 15 of the housing and retain the plate 3.

Figure 2:
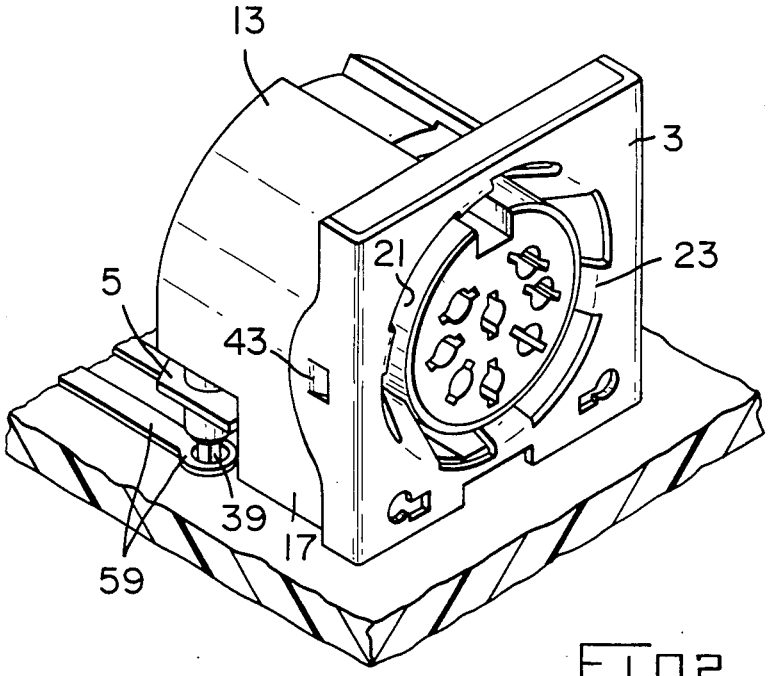
FIG. 2 is a perspective view of the assembled receptacle attached to a printed circuit board.
Figure 4:
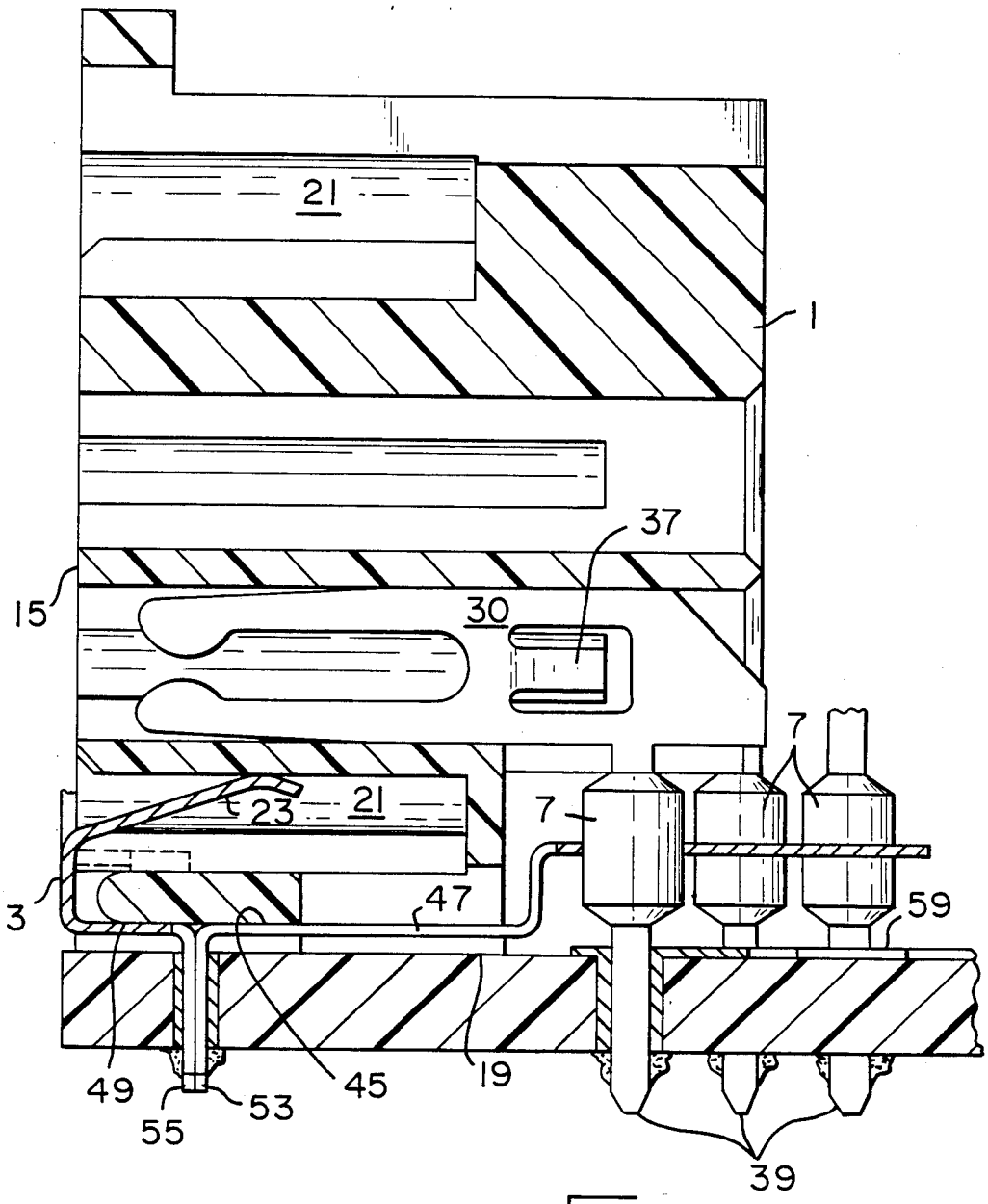
FIG. 4 is a cross-sectional view of the assembled receptacle.

Referring specifically to FIGS. 2, 3 and 4 the housing is recessed between the surfaces 19 at the sides of the housing to provide a further surface 45 to accept a platform 47 downwardly offset from and generally parallel to the part of the filter ground plate in which the filters are located. The offset platform 47 extends under and is in contact with the surface 45 lending rigidity to the filter member support. The ground plate 3 has a platform 49 which also extends under and is in contact with the surface 45.

When the receptacle structure is applied to a printed circuit board or surface of another contact element, fingers 53 extending from platform 47 at right angles and fingers 55 extending at right angles from platform 49 enter holes in the printed circuit board and are soldered to ground leads and/or grounded plated through holes 57 on the board securing the structure to the board as well as grounding the plates 3 and 5.

The legs 39 also engage leads on the printed circuit board such as lead 59 and are soldered thereto and provide support as well as electrical connection.

When the receptacle receives a pin connector, the shell of the connector enters the annulus 21 and engages the spring fingers 23 with a wiping motion ensuing a good electrical contact between the ground planes of the two parts of the connector assembly. The pins of the pin connector enter the bores 25 spreading the springy tines into the slots 27 and 29 in FIG. 1 and again insuring a good wiping contact. Pin alignment is achieved by a key on the pin connector shell which enters a keyway in the center barrel of the housing 1.

It should be noted that the socket contacts, ground plate and filter ground plate are all stampings which are economical and contribute to the cost effectiveness of the receptacle as do the ease of assembly and the easily molded header housing.

Other improvements, modifications and embodiments will become apparent to one of ordinary skill in the art upon review of this disclosure. Such improvements, modifications and embodiments are considered to be within the scope of this invention as defined by the following claims.

We claim:

1. An electrical connector, comprising:

a dielectric housing member having a plurality of passageways extending through said housing member, said passageways extending parallel to a longitudinal axis of said housing member, said housing member having recess means extending inwardly from a front surface of said housing member for at least part way of said housing member;

electrical contact members secured in said passageways and having contact sections in said passageways and terminal sections extending along a rear surface of said housing member as well as beyond a bottom surface of said housing member for electrical connection to conductive areas of a circuit board;

filter means on said terminal sections and having inside surfaces electrically connected to said terminal sections, most of said filter means being disposed in a recessed section located at a rear bottom portion of said housing member; and ground plate means having a first and second section of which at least a part extends along an inner surface of said housing member spaced inwardly from said bottom surface, said first section extending rearwardly from said part and being disposed in said recessed section and having apertures in which the filter means are located and electrically connected to the ground plate means, said second section extending forwardly from said part and extending along the front surface of said housing member and including spring fingers disposed in said recess means for electrical connection with a complementary electrical connector.

2. The electrical connector as described in claim 1 wherein said housing means comprises a receptacle housing.

3. The electrical connector as described in claim 1 wherein said electrical contact means are splayed out in an essentially circular configuration with respect to a centrally located contact member.

4. The electrical connector as described in claim 1 wherein the electrical contact members have at least one spring finger means extending therefrom for latchingly engaging said housing means whereby said contact member is retained in said housing means.

5. The electrical connector as described in claim 1 wherein said recess means is an annular recess.

6. The electrical connector as described in claim 5 wherein the electrical contact members have at least one spring finger means extending therefrom for latchingly engaging said housing means whereby said contact member is retained in said housing means.

* * * * *